US010106918B1

(12) United States Patent
Uddavolu et al.

(10) Patent No.: US 10,106,918 B1
(45) Date of Patent: Oct. 23, 2018

(54) RADIATION SHIELDING CLOTHING

(71) Applicants: Rajendhar Uddavolu, Peoria, IL (US); Suresh Algonda Patil, Peoria, IL (US)

(72) Inventors: Rajendhar Uddavolu, Peoria, IL (US); Suresh Algonda Patil, Peoria, IL (US)

( * ) Notice: Subject to any disclaimer, the term of this patent is extended or adjusted under 35 U.S.C. 154(b) by 0 days.

(21) Appl. No.: 15/600,832

(22) Filed: May 22, 2017

(51) Int. Cl.

| | |
|---|---|
| ***D02G 3/02*** | (2006.01) |
| ***D02G 3/12*** | (2006.01) |
| ***D02G 3/44*** | (2006.01) |
| ***D04B 1/10*** | (2006.01) |
| ***D04B 1/12*** | (2006.01) |
| *G21F 3/02* | (2006.01) |

(52) U.S. Cl.
CPC ..... *D02G 3/12* (2013.01); *D02G 3/441* (2013.01); *D04B 1/102* (2013.01); *D04B 1/12* (2013.01); *A41D 2400/26* (2013.01); *A41D 2500/10* (2013.01); *D02G 3/02* (2013.01); *D02G 3/44* (2013.01); *D04B 1/10* (2013.01); *D10B 2101/20* (2013.01); *D10B 2201/02* (2013.01); *D10B 2401/22* (2013.01); *D10B 2501/02* (2013.01); *G21F 3/02* (2013.01)

(58) Field of Classification Search
CPC .. G21F 3/02; G21F 3/025; A61N 1/16; A61N 2005/1094; B03D 15/00; D03D 1/0058; D03D 15/077; D03D 15/0088; D03D 15/08; D03D 15/0066; D03D 15/027; D03D 15/00; D10B 2101/20; D10B 2201/02; D10B 2501/00; D10B 2401/16; D10B 2201/04; D10B 2401/22; D10B 2501/02; D10B 2331/02; D10B 2331/04; D10B 2403/0114; D10B 2403/0243; D10B 211/02; D10B 211/04; D02G 3/441; D02G 3/12; D02G 3/02; D02G 3/44; D02G 3/32; C21F 3/02; Y10T 442/2598; Y10T 442/2607; Y10T 442/30; Y10T 442/413; Y10T 442/3024; Y10T 442/45; Y10T 442/40; Y10T 442/3976; D04B 21/12; D04B 1/102; D04B 1/10; D04B 1/12; D04B 1/14; A41D 2400/26; A41D 2500/10
USPC ..... 442/312, 313, 314, 132, 133, 316, 181, 442/184, 301, 304, 306; 2/457; 250/516.1
See application file for complete search history.

(56) References Cited

U.S. PATENT DOCUMENTS 4,753,088 A * 6/1988 Harrison ..... D04B 21/12 2/125
2006/0264137 A1* 11/2006 Ishihara ..... A41D 31/0066 442/304

* cited by examiner

*Primary Examiner* — Camie S Thompson
(74) *Attorney, Agent, or Firm* — Gulf Coast Intellectual Property Group

(57) ABSTRACT

The present invention comprises a radiation blocking clothing material utilized to construct articles of clothing such as but not limited to undergarments. The radiation blocking clothing material includes a first thread fiber, a second thread fiber and a third thread fiber constructed in a double sided knit structure. The double-sided knit structure promotes the material of the first thread fiber and second thread fiber to be on one side of the body of the radiation blocking clothing. The first thread fiber is a 84 D DTY silver fiber and the second thread fiber is a 90D DTY silver thread fiber and the conductive silver functions to block radiation having Faraday properties. The third thread fiber is manufactured from a cotton or a cotton blend. The composition of the body is operable to include a range of silver content within the range of 48 to 62 percent.

19 Claims, 2 Drawing Sheets

RADIATION SHIELDING CLOTHING

FIELD OF THE INVENTION

The present invention relates generally to radiation shielding for humans, more specifically but not by way of limitation, radiation shielding clothing such as but not by way of limitation, undergarments, manufactured from a fabric constructed according to the present invention.

BACKGROUND

Everyday millions of people are exposed to electromagnetic radiation. There are different sources of radiation that can produce harmful effects for humans. The higher the frequency of the radiation the more damage it is likely to cause to a human. Microwaves are an exemplary source of radiation that is known to cause damage to human cells. A very common type of radiation that most humans are exposed to is electromagnetic radiation. Sources of electromagnetic radiation are commonly utilized devices such as but not limited to cell phones and wireless routers. This type of radiation emitted by electronics is non-ionizing radiation, which does not have the ability to break chemical bonds as some of the other stronger types of radiation can do. Electromagnetic radiation does however interact with our body, which can potentially lead to indirect damage following longer term exposure.

The proliferation of electronic devices in the world has placed great concern on the ability to shield electromagnetic interference. Given the unknown long term exposure effects, humans could potentially be vulnerable to the consistent exposure to radiation. Electromagnetic shielding has become a more prominent concern but few options are available for the everyday consumer to protect themselves from radiation exposure. As is known in the art, attenuation is a principal indicator for measuring the effectiveness of electromagnetic interference shielding. It refers to the difference between an electromagnetic signal's intensity before shielding and its intensity after shielding. Attenuation is measured in decibels (dB) that correspond to the ratio between field strength with and without the presence of a protective medium. The decrease in a signal's intensity, or amplitude, is usually exponential with distance, while the decibel range falls along a logarithmic scale. By way of example but not limitation, an attenuation rating of 50 dB indicates a shielding strength ten times that of 40 dB. Existing clothing has been shown to be incapable of blocking radiation at a level of 50 dB. Further, attempts to manufacture garments from radiation blocking cloth have not yielded a fabric composition that provides both effective radiation blocking and comfort to the wearer.

Accordingly, there is a need for a cloth having a composition that is operable to block radiation up to a level of 50 dB wherein the cloth is utilized to manufacture clothing such as but not limited to undergarments.

SUMMARY OF THE INVENTION

It is the object of the present invention to provide a radiation blocking clothing that comprises a composition of materials that is operable to block radiation having an effectiveness of at least 50 dB.

Another object of the present invention is to provide radiation blocking garments manufactured from a fabric composition wherein the fabric composition includes a first fiber wherein the first fiber is a silver fiber.

A further object of the present invention is to provide a radiation blocking garment manufactured from a fabric composition wherein the fabric composition includes a second fiber wherein the second fiber is formed from a combination nylon and silver.

An additional object of the present invention is to provide a radiation blocking garment manufactured from a fabric composition wherein the fabric composition includes a third fiber wherein the third fiber is formed from cotton.

An alternative object of the present invention is to provide a radiation blocking garment manufactured from a cloth having a first fiber, a second fiber and a third fiber, wherein the first fiber, second fiber and third fiber are structured in a particular pattern.

Yet a further object of the present invention is to provide a radiation blocking garment manufactured from a cloth having a first fiber, a second fiber and a third fiber, wherein the pattern of the first fiber, second fiber and third fiber functions as a Faraday shield.

An additional object of the present invention is to provide a radiation blocking garment manufactured from a cloth wherein the cloth provides alternate materials on opposite sides of the cloth.

Still another object of the present invention is to provide a radiation blocking garment manufactured from a cloth wherein the structure of the cloth provides a surface resistance of a range between 0.01 to 0.5 ohms.

Yet a further object of the present invention is to provide a radiation blocking garment manufactured from a cloth wherein at least one embodiment of the present invention is an undergarment to be worn by a user.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
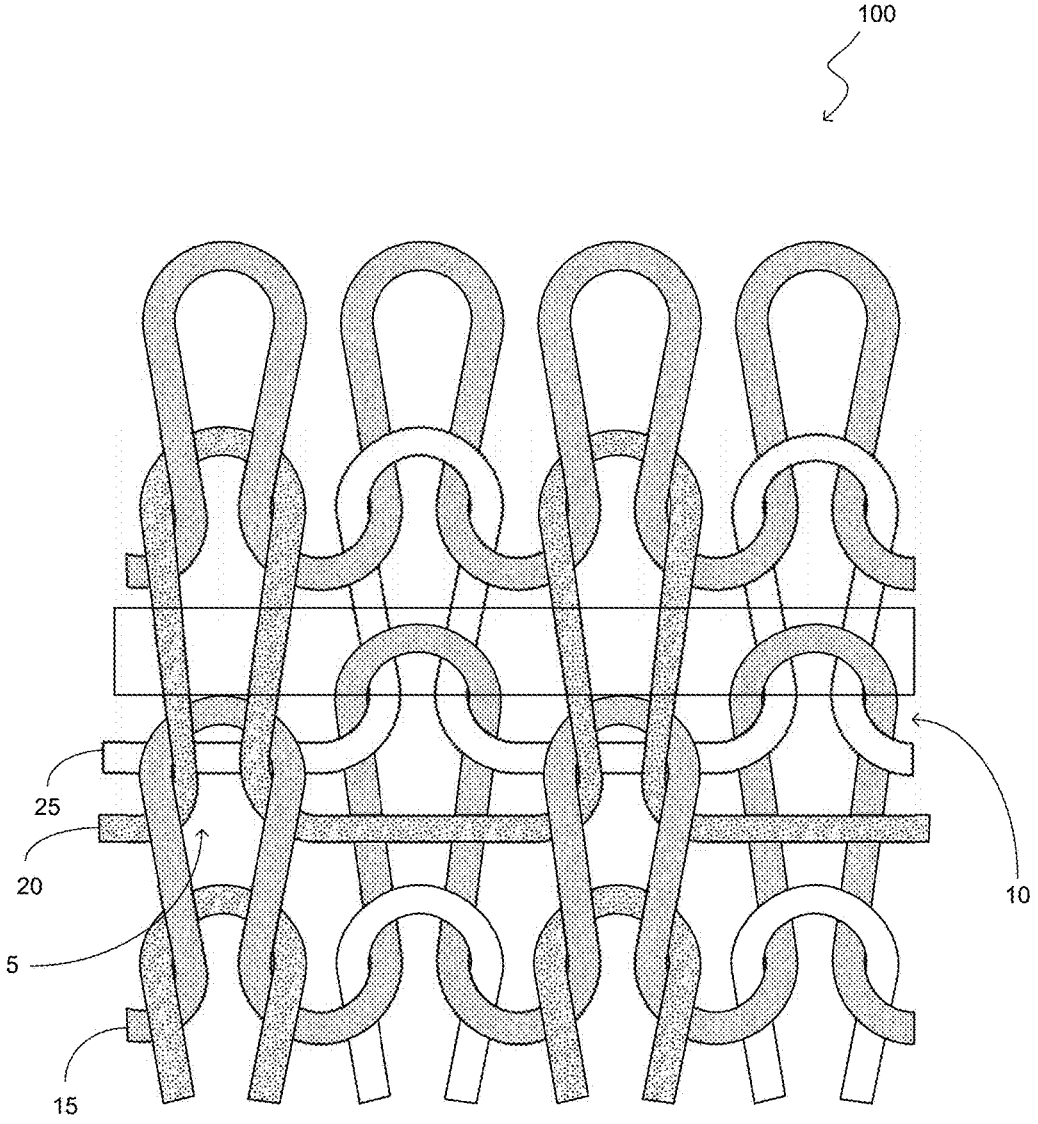
FIG. 1 is a detailed view of the thread fiber structure of the present invention.

Referring now to the drawings submitted herewith, wherein various elements depicted therein are not necessarily drawn to scale and wherein through the views and figures like elements are referenced with identical reference numerals, there is diagrammed a radiation shielding clothing material 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Referring now to the drawings submitted herewith, the radiation shielding clothing material 100 includes a first side 5 and a second side 10 and is configured to be flexible. The radiation shielding clothing material 100 is contemplated within the scope of the present invention to be utilized to manufacture various clothing articles. A preferred clothing article to be manufactured within the scope of the present invention are various forms of undergarments such as but not limited to underwear. It is further contemplated within the scope of the present invention that the radiation shielding clothing material 100 could be utilized to manufacture numerous styles and types of clothing.

Referring in particular to FIG. 1 herein, the specific thread structure of the present invention is illustrated therein. The radiation shielding clothing material 100 comprises a first thread fiber 15, a second thread fiber 20 and a third thread fiber 25 structured in a specific pattern so as to achieve the desired results of blocking radiation with an effectiveness of 50 dB. The exemplary preferred pattern of the present invention illustrated in FIG. 1 herein is known as double sided knit structure. The aforementioned structure provides a completed radiation shielding clothing material 100 that has a first material on the first side 5 and a second material on the second side 10. In the present invention as will be further discussed herein, having a first material on the first side 5 and second material on the second side 10 provides a technique to accomplished the desired radiation blocking effectiveness.

The first thread fiber 15 of the present invention is 84D FDY silver fiber. As is known in the art, D is an abbreviation for denier, which is a unit of measure for the linear mass density of the fiber. Thread fibers are manufactured utilizing various techniques and the first thread fiber 15 is manufactured utilizing a fully drawn yarn(FDY) technique. While good results have been achieved utilizing 84D FDY silver fiber to manufacture the first thread fiber 15, it is contemplated within the scope of the present invention that the first thread fiber 15 could be manufactured having a denier range of 70D to 94D and still achieve the desired outcome wherein the radiation shielding clothing material 100 is capable of blocking radiation with an effectiveness of 50 dB.

Figure 2:
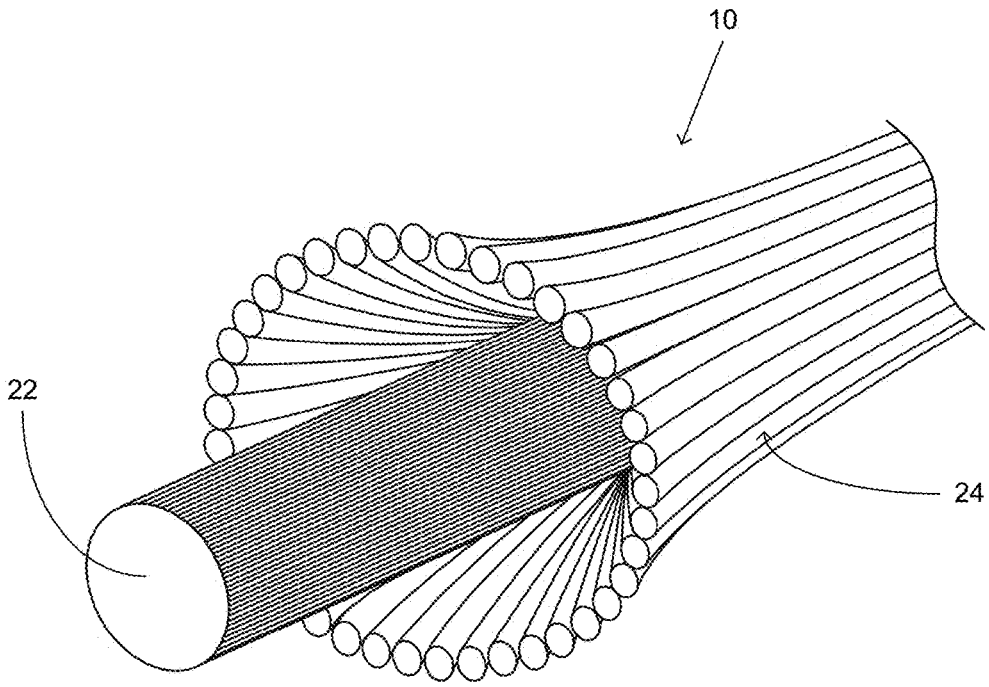
FIG. 2 is a detailed view of the DTY fiber of the present invention.
Figure 3:
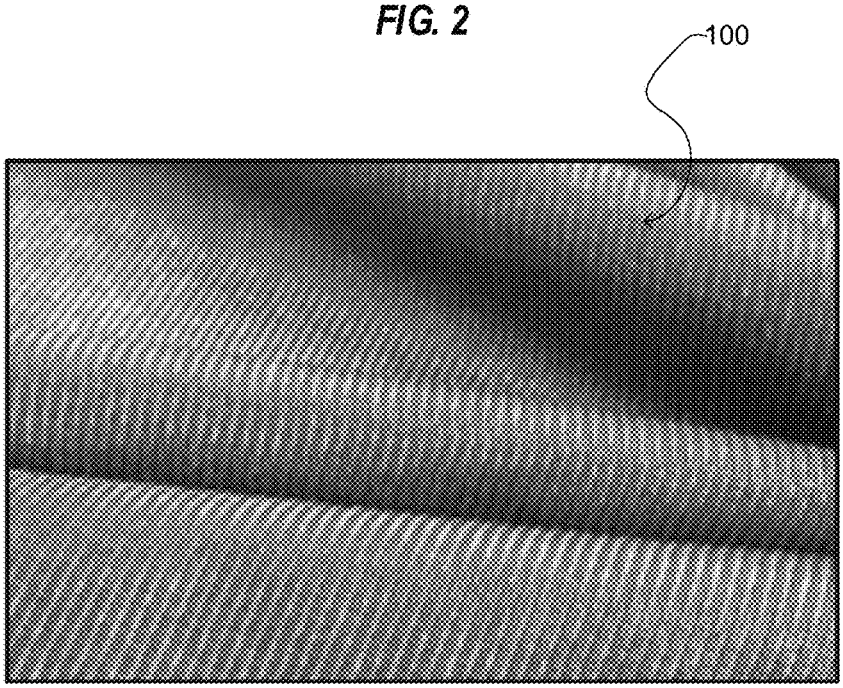
FIG. 3 is a perspective view of the cloth of the present invention.

The second thread fiber 20 of the present invention is 90D DTY silver fiber of which a detailed illustration is provided in FIG. 2 herein. As is known in the art, a DTY thread fiber is manufactured from a process referred to as draw textured yarn(DTY). The second thread fiber 20 includes a core material 22 of nylon or similar synthetic fiber and an outer layer 24 of silver. The second thread fiber 20 functions in conjunction with the first thread fiber 15 so as to provide the desired radiation blocking effectiveness described herein. While a 90D DTY silver fiber is the preferred embodiment for the second thread fiber 20, it is contemplated within the scope of the present invention that the second thread fiber 20 could be manufactured within a denier range wherein the radiation shielding clothing material 100 could still achieve the desired radiation blocking effectiveness. More specifically but not by way of limitation, the second thread fiber 20 could be manufactured within a denier range of 80D to 95D.

The third thread fiber 25 of the present invention is a 40S cotton fiber. As is known in the art, 40S refers to the count of cotton within a thread fiber. It is contemplated within the scope of the present invention that the third thread fiber 25 could be manufactured from alternate materials or a combination of cotton and alternate materials. By way of example but not limitation, it is contemplated within the scope of the present invention that the third thread fiber 25 could comprise of a cotton and spandex blend. The aforementioned structure of the radiation shielding clothing material 100 of the present invention is such that the first thread fiber 15 and second thread fiber 20 will be present on the first side 5 creating the outer layer of the radiation shielding clothing material 100. While the third thread fiber 25 will be present on the second side 10 of the radiation shielding clothing material 100 which enables the ability to provide an improved comfort to the wearer of the garment manufactured utilizing the radiation shielding clothing material 100.

The structure of the radiation shielding clothing material 100 is such that the first thread fiber 15 and second thread fiber 20 are adjacent due to the weave structure discussed herein and present on the first side 5. The proximity of the first thread fiber 15 and second thread fiber 20 are such that the surface resistance of the first side 5 approximately ranges between 0.01 to 0.5 ohms. The aforementioned structure in combination with the materials utilized to construct the first thread fiber 15 and second thread fiber 20 enable the radiation shielding clothing material 100 to possess Faraday properties. Faraday properties are achieved through utilization of the conductive materials of the first thread fiber 15 and second thread fiber 20 and the proximity of the first thread fiber 15 and second thread fiber 20 to each other. The low surface resistance of the first side 5 resulting from the aforementioned structure facilitates the blocking of electromagnetic radiation with an effectiveness of 50 dB. It is the combination of materials utilized to construct the first thread fiber 15 and second thread fiber 20 in conjunction with the radiation shielding clothing material 100 structure described herein that achieve the desired effectiveness of radiation blocking. The silver content of the first thread fiber 15 and second thread fiber 20 present on the first side 5 and the low surface resistance acts as a conducting surface thus absorbing the electromagnetic radiation.

The radiation shielding clothing material 100 composition, specifically the percentage of silver provides the desired radiation blocking effectiveness of 50 dB. The percentage silver as a part of the total composition of the radiation shielding clothing material 100 utilized is 48 to 62 percent. Remaining percentages consistent of cotton or a blend of cotton and other suitable fabric such as but not limited to spandex. Good results have been achieved incorporating approximately four percent of spandex material as part of the overall composition of the radiation shielding clothing material 100. It is further contemplated within the scope of the present invention that the percentage of cotton as part of the overall composition of the radiation shielding clothing material 100 be within the range of 38 to 52 percent.

While in the preferred embodiment, silver has been utilized as the source for conductive material in order to achieve the desired radiation blocking effectiveness. It is further contemplated within the scope of the present invention that other conductive metals could be utilized in place of and/or in conjunction with silver. More specifically but not by way of limitation, it is contemplated within the scope of the present invention that copper could be utilized in place of silver wherein the amount of copper would be equal to the amount of silver described herein both in thread fiber construction and total composition percentage of the radiation shielding clothing material 100.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A radiation blocking clothing material comprising:

a first thread fiber, a second thread fiber and a third thread fiber, said first thread fiber, said second thread fiber and said third thread fiber being structured such that the radiation blocking clothing material has a first side and a second side, said first thread fiber and said second thread fiber being manufactured from a conductive material, said first side and said second side of the radiation blocking clothing material being comprised of different materials, said first side being comprised of said first thread fiber and said second thread fiber; and wherein the first thread fiber and second thread fiber having the conductive material are structured so as to be proximate each other and provide an electromagnetic shielding of at least 50 dB and wherein said first thread fiber is a FDY conductive metal thread fiber having a denier between the range of 70D to 94D.

2. The radiation blocking clothing material as recited in claim 1, wherein said second thread fiber is a DTY conductive metal thread fiber having a denier between the range of 80D to 95D.

3. The radiation blocking clothing material as recited in claim 2, wherein the first side of the radiation blocking clothing material has a surface resistance having a range between 0.01 to 0.5 ohms.

4. The radiation blocking clothing material as recited in claim 3, wherein the third thread fiber is cotton.

5. The radiation blocking clothing material as recited in claim 3, wherein the third thread fiber is a cotton synthetic blend material.

6. The radiation blocking clothing material as recited in claim 5, wherein the conductive metal is selected from one of the following: copper or silver.

7. The radiation blocking clothing material as recited in claim 5, wherein the conductive metal comprises between 48 to 62 percent of the radiation blocking clothing material.

8. The radiation blocking clothing material as recited in claim 7, wherein the radiation blocking material is utilized to manufacture undergarments.

9. A radiation blocking clothing material comprising:

a body, said body being flexible in manner, said body having a first thread fiber, a second thread fiber and a third thread fiber, said first thread fiber, said second thread fiber and said third thread fiber being structured such that the body of the radiation blocking clothing material has a first side and a second side, said first side being manufactured from said first thread fiber and said second thread fiber, said first thread fiber and said second thread fiber including silver; and wherein the first thread fiber and second thread fiber are structured utilizing a double sided knit structure so as to be proximate each other in order to provide a low surface resistance for the first side of the body and provide an electromagnetic shielding of at least 50 dB.

10. The radiation blocking clothing material as recited in claim 9, wherein the first side of the body of the radiation blocking clothing material has a surface resistance having a range between 0.01 to 0.5 ohms.

11. The radiation blocking clothing material as recited in claim 10, wherein said first thread fiber is a FDY silver thread fiber having a denier between the range of 70D to 94D.

12. The radiation blocking clothing material as recited in claim 11, wherein said second thread fiber is a DTY silver thread fiber having a denier between the range of 80D to 95D.

13. The radiation blocking clothing material as recited in claim 12, wherein the silver thread fiber comprises between 48 to 62 percent of the radiation blocking clothing material.

14. The radiation blocking clothing material as recited in claim 13, wherein the third thread fiber is cotton.

15. The radiation blocking clothing material as recited in claim 13, wherein the third thread fiber is a cotton synthetic blend material.

16. A radiation blocking clothing material comprising:

a body, said body being flexible in manner, said body having a first thread fiber, a second thread fiber and a third thread fiber, said first thread fiber, said second thread fiber and said third thread fiber being structured utilizing a double sided knit structure such that the body of the radiation blocking clothing material has a first side and a second side, said first side being manufactured from said first thread fiber and said second thread fiber, said first thread fiber and said second thread fiber including silver, said first thread fiber being a 84D FDY silver thread fiber, said second thread fiber being a 90D DTY silver thread fiber; and wherein the first thread fiber and second thread fiber are structured utilizing a double sided knit structure so as to be proximate each other in order to provide a resistance having a range between 0.01 to 0.5 ohms for the first side of the body and provide an electromagnetic shielding of at least 50 dB.

17. The radiation blocking clothing material as recited in claim 16, wherein the silver content of the first thread fiber and the second thread fiber comprises between 48 to 62 percent of the radiation blocking clothing material.

18. The radiation blocking clothing material as recited in claim 17, wherein the third thread fiber is cotton.

19. The radiation blocking clothing material as recited in claim 18, wherein the radiation blocking material is utilized to manufacture undergarments.

* * * * *